United States Patent [19]

Sobota

[11] 3,981,084

[45] Sept. 21, 1976

[54] CLOSED DRAW TRANSFER SYSTEM WITH GASEOUS PRESSURE DIRECTION OF WEB

[75] Inventor: John T. Sobota, Green Bay, Wis.

[73] Assignee: Fort Howard Paper Company, Green Bay, Wis.

[22] Filed: May 1, 1974

[21] Appl. No.: 465,895

Related U.S. Application Data

[63] Continuation-in-part of Ser. No. 263,798, June 19, 1972, abandoned.

[52] U.S. Cl. ..... 34/123; 34/152; 162/290; 162/307; 162/359; 162/360 R

[51] Int. Cl.[2] ..... D21F 5/02; D21F 9/02

[58] Field of Search ..... 162/202, 204, 205, 207, 162/290, 306, 307, 348, 358, 359, 360 R, 363, 369, 370, 371, 372; 34/18, 123, 152, 162; 100/118, 153, 174, 176

[56] References Cited

UNITED STATES PATENTS

| | | | |
|---|---|---|---|
| 1,297,192 | 3/1919 | LeRoy et al. | 162/359 |
| 1,479,265 | 1/1924 | Tompkins | 162/358 X |
| 1,701,226 | 2/1929 | Collins | 162/290 |
| 2,888,074 | 5/1959 | Hornbostel | 162/358 X |
| 3,111,454 | 11/1963 | Tucker et al. | 162/370 X |
| 3,560,333 | 2/1971 | Douglas et al. | 162/360 X |
| 3,839,146 | 10/1974 | Fleissner | 162/290 X |

FOREIGN PATENTS OR APPLICATIONS

| | | | |
|---|---|---|---|
| 1,178,691 | 9/1964 | Germany | 162/306 |

*Primary Examiner*—S. Leon Bashore
*Assistant Examiner*—Richard V. Fisher

[57] ABSTRACT

A paper making apparatus and process of the type wherein the paper is processed from a starting condition of a slurry of pulp fiber to a later condition of a continuous self-sustaining paper sheet. The paper is carried continuously along a preselected path of travel extending from the starting condition to the later condition and for processing the paper as it is being carried. The path of travel normally includes a plurality of pairs of contacting members, including a forming wire and a pick-up felt, a pick-up felt and a bottom felt, and a pick-up felt and Yankee dryer, such contacting members processing the paper. The paper is passed through each nip defined by each of the contacting members and continues along its desired path of travel. Air pressure is applied on the discharge side or outgoing side of one or more of the nips defined between the sets of contacting members. The air pressure is applied in a direction which causes the paper to remain in the desired path of travel and to avoid deviation thereof from the desired path of travel.

4 Claims, 6 Drawing Figures

CLOSED DRAW TRANSFER SYSTEM WITH GASEOUS PRESSURE DIRECTION OF WEB

REFERENCE TO RELATED APPLICATION

This is a continuation-in-part of my copending application U.S. Ser. No. 263,798, filed June 19, 1972 now abandoned.

BACKGROUND OF THE INVENTION FIELD OF THE INVENTION AND DEPSCRIPTION OF THE PRIOR ART

This invention relates to an apparatus and process for making paper and it particularly relates to an apparatus and process for continuously moving paper being processed along a preselected and desired path of travel while avoiding deviation of the paper from the desired path of travel; and more specifically, the invention herein relates to a closed draw type of paper making machine.

Two basic types of paper transfers made in conventional paper making machines are the "closed draw" type and the "open draw" type. Generally speaking, the closed draw system, involved in the present invention, is one wherein a nip is defined between two contacting members, such as an upper felt and a lower felt, a forming wire and a felt, or a felt and a Yankee dryer. The closed draw type of paper transfer is in contrast to the open draw type, not involved herein, which has the paper pass across an open space from one paper contacting member to another such member, and no nip is defined between the members.

Problems encountered with transferring paper across an open space in the open draw system is quite different from problems encountered when transferring paper between two contacting members defining a nip in a closed draw system. Simply stated, in the open draw system, once the paper has been transferred from one member to the other, the paper generally remains in contact with the receiving member without difficulty. However, in the closed draw system, problems are encountered in maintaining the paper in the desired path of travel becuase the paper sometimes tends to be carried with the wrong contacting member after passing through the nip defined between the contacting or processing members. The invention herein relates to improvements in the transfer of paper in paper making machines of the closed draw type, as distinguished from the open draw system.

In the processing of paper to make various types of paper materials, such as "wet" or "dry" crepe tissue paper, toweling, and the like, the paper processing is conventionally performed on various types of Fourdrinier paper making machines. In a conventional Fourdrinier paper making machine, a slurry of pulp fiber, at a concentration of about 0.2 to 0.6% is placed or squirted on a forming wire at the slice section of the machine. Water immediately begins to drain from the pulp by gravity through the forming wire. The drainage is assisted by the action of various water removal devices, such as a suction breast roll, forming board, foils, rolls, suction boxes and suction hip roll. The paper is carried to a first nip between the forming wire and the top pick-up felt. The pick-up felt is backed up by a "kiss" pick up roll, a shoe, or a suction pick-up roll. At this nip or contact point, the paper sheet is transferred from the wire to the pick-up felt. The pick-up felt carries the paper sheet on its underside to the press section of the machine, where more water is removed from the paper. At the press section, paper is normally carried by the pick-up felt between a top press and a bottom press roll; although depending on the particular machine, no press section may be used in processing certain types of paper. Following passage through the nip of the press, the paper sheet must stay with the top pick-up felt and must not transfer to the bottom felt.

Following the press section, the paper sheet is carried by the top pick-up felt to the nip defined between the first pressure roll and the hot, smooth surface of the Yankee dryer. At this nip, the paper is transferred from the pick-up felt to the Yankee dryer surface. Following this, the paper sheet may be compacted or pressed between a second pressue roll and the Yankee dryer. The paper is carried on the Yankee dryer to a doctor blade which crepes and removes the self-sustaining paper from the surface of the Yankee dryer. The paper is thereafter either wound up on a reel or passed around after-dryers and then wound up on a reel.

From the foregoing, it is seen that there are at least three times, during normal paper processing or making, when the paper sheet must pass between a pressure point or nip between contacting members. In the event that, if during passage through any of these pressure points, the paper sheet does not remain in the desired and preselected path of travel, production will be interrupted and there may be resulting damage to the equipment. It is thus very important to minimize the risk of production stoppage and/or machinery damage because of the significant expenses which might result from production shutdown and machinery damage.

There are several theories as to why a paper sheet being processed does or does not follow the desired preselected path of travel. One theory as to why the paper sheet moves in the desired path of travel is that following passage through a nip, the paper sheet follows the smoother of the two contacting members at the outgoing or discharge side of the nip. In this regard, at the "kiss" pick-up point, the contacting members are the forming wire and the pick-up felt. Since the surface of the woven pick-up felt is smoother than the relatively rough surface of the forming wire, the paper sheet leaves the forming wire and follows the felt. In fact, it has been found that, by wetting the surface of the top pick up felt with water, the felt surface becomes even smoother so as to facilitate the proper transfer of the wet paper sheet from the forming wire to the pick-up felt.

As a further example of the above theory, when a bottom felt is used in the paper making machine, the bottom felt is intentionally less smooth than the top pick-up felt; since it is not as smooth as the top pick-up felt, the paper remains with the smoother top felt at the outgoing side of the nip.

Although, in theory, paper should continue movement in its desired and preselected path of travel, in both of the above-mentioned conditions, at the transfer point between the wire and the pick up felt, other problems may occur. At high speeds and unless the pick-up felt surface is wet with water to provide a smooth surface, or if the paper sheet is pressed into the mesh of the forming wire, the paper may not properly transfer to the pick-up felt and production may be interrupted. In the press section, although the bottom felt is intentionally maintained less smooth than the pick-up felt, when a new pick-up felt is installed and the bottom felt is old and worn smooth, there is sometimes a tendency for the paper sheet to follow the bottom felt. When this occurs, it is not unusual for the bottom felt to be replaced even though there is a significant amount of use remaining in the bottom felt.

At the nip between the hot smooth Yankee dryer surface and the top pick-up felt, it might be expected that there would be no problem of transfer from the pick-up felt to the Yankee dryer surface, because the Yankee dryer surface is very smooth as compared to the pick-up felt. However, there is a tendency for the cold paper sheet to blister from the hot Yankee dryer surface when the wet sheet touches the surface. Another theory as to why the wet paper sheet sometimes tends to blister from the hot Yankee dryer surface is that a negative pressure is produced at the outgoing or discharge side of the nip. This negative pressure reduces the boiling point of the water, thereby increasing the tendency of the sheet to blister from the hot surface and to undesirably follow the top felt and interrupt production.

In the case of heavy and well closed paper sheets, the blistering problem is accentuated and sometimes it is necessary to make a compromise between various parameters, including the temperature of the Yankee dryer surface, amount of pulp refining, and the speed of the machine while the sheet is formed so that the machine will run safely without any interruptions. Any such compromise, however, has the obvious disadvantage of creating a production slowdown and of compromising quality.

Prior art patents showing various paper processing machines, both of the closed draw type and of the open draw type, are Pope U.S. Pat. No. 1,338,094; Monaghan U.S. Pat. No. 1,581,656; Goodwillie U.S. Pat. No. 2,694,346; Dearden U.S. Pat. No. 2,780,967; Nykopp U.S. Pat. No. 3,655,507; Douglas et al U.S. Pat. No. 3,560,333; Millspaugh U.S. Pat. No. 1,163,252; Rance et al U.S. Pat. No. 2,990,013; Murray et al U.S. Pat. No. 3,351,521; British Pat. No. 812,914; and Canadian Pat. No. 452,200. A number of these patents recognize problems encountered in transferring paper and in maintaining the paper in the desired path of travel.

For example, the Pope patent shows the use of an air blast to assist in transferring paper in an open draw transfer system. Also, the Monaghan patent shows the use of air pressure applied on the underside of the forming wire to separate the paper from the forming wire, but again, in an open draw system, the type of paper transferring not involved herein.

The Goodwille patent relates to the transfer of paper between two processing members wherein a "dandy roll" bridges the gap between two of the processing members. The Goodwille patent recognizes the differences between closed draw and open draw systems and seems to suggest a "hybrid" system by using the "dandy roll" and air blasts in an open draw system.

The Dearden patent shows a closed draw system using an air blast to assure initial transfer of the "tail" from the forming wire only. When the tail has been transferred, the air supply to the blow roll is cut off. The air blast is applied on the ingoing side of the nip.

The Nykopp broadly shows a closed draw system, wherein a blow roll, on the incoming side of the nip, introduces heated air to the space before the press nip to maintain or increase the differential pressure so as to enhance water removal.

The Douglas et al patent uses steam applied to the surface of the paper web prior to the nip between that suction roll and the Yankee dryer. The Millspaugh patent shows an open draw system, which uses air pressure pipes inside of a suction roll to help the paper transfer. The Rance et al patent shows an open draw system, wherein at the point where the paper leaves the forming wire, a box is provided with suction and pressure slots therein.

The Murray patent again shows an open draw system with air being blown against the lower side of the wire to loosen the web prior to transfer.

The British patent shows an open draw system using an air blast. The Canadian patent shows a press section with an pneumatically loaded hood to apply pressure to the paper pulp.

SUMMARY OF THE INVENTION

It is therefore an important object of this invention to provide an improved paper making apparatus and process, in a closed draw system, wherein the paper is continuously carried along a desired preselected path of travel while avoiding undesired deviation therefrom.

It is also an object of this invention to provide an improved paper making process and apparatus wherein the paper passing through a nip between contacting members of the paper making apparatus moves only in the desired path of travel following passage through a nip.

It is yet another object of this invention to provide an improved paper making apparatus and process wherein air pressure is applied to the moving paper from the discharge side of the nip and from a direction to cause the paper to remain in the desired path of travel while avoiding deviation of the paper from the desired path of travel.

It is a further object of this invention to provide an improved paper making apparatus and process wherein the transfer of a paper sheet at the nip between a forming wire and a pick-up felt is improved by applying air pressure through the wire and against the paper to assure the desired transfer of the paper to the pick-up felt.

It is another object of this invention to provide an improved paper making apparatus and process wherein air pressure is applied against the paper at the press section to cause the paper to remain with the top pick-up felt at the discharge side of the nip, even without the use of a bottom felt.

It is still another object of this invention to provide an improved paper making process and apparatus wherein paper is transferred from a pick-up felt to the hot surface of a Yankee dryer wherein the tendency of the paper to blister from the hot Yankee dryer surface is greatly reduced by applying air pressure against the paper and through the pick-up felt.

It is still a further object of this invention to provide an improved paper making process and apparatus wherein the objective of continuously moving a sheet of paper along a desired and preselected path of travel, particularly at the discharge side of the nip between contacting machine members, is substantially assured, the process and apparatus being particularly characterized by efficiency in operation and simplicity in construction.

Further purposes and objects of this invention will appear as the specification proceeds.

The foregoing objects are accomplished by providing an improved paper making apparatus and process wherein the paper is processed from a starting condition of a slurry of pulp fibers to a later condition of a continuous self-sustaining paper sheet, the apparatus including means for continuously carrying, while processing, the paper along a desired preselected path of travel extending from a first position where the paper is at the starting condition and to a second position where the paper is at the later condition, the carrying and processing means including a plurality of pairs of contacting members such as a forming wire and a pick-up felt, a pick-up felt and a bottom press roll or a pick-up felt and a bottom felt, and a pick-up felt and a Yankee dryer surface, a nip being defined between each of the contacting member pairs, the paper passing through each of the nips and continuing along the desired path of travel and means located on the discharge or outgoing side of one or all of the nips for continuously applying air pressure to the paper from a direction which causes the paper to continue in the desired and preselected path of travel while avoiding deviation of the paper from the said preselected and desired path of travel.

BRIEF DESCRIPTION OF THE DRAWINGS

Particular embodiments of the present invention are illustrated in the accompanying drawings wherein.

DETAILED DESCRIPTION OF THE PREFERRED EMBODIMENTS

In the following description of my inventive apparatus and process, it is to be understood that my invention may be used for manufacturing various types of paper including paper toweling, tissue, crepe paper, and the like. Also, the invention is useful with a variety of Fourdrinier type paper making machines wherein the paper passes between contacting members of the machine and must remain in the desired path of travel during passage through the machine. The invention is directed to improvements in closed draw paper process systems as opposed to open draw systems.

Figure 1:
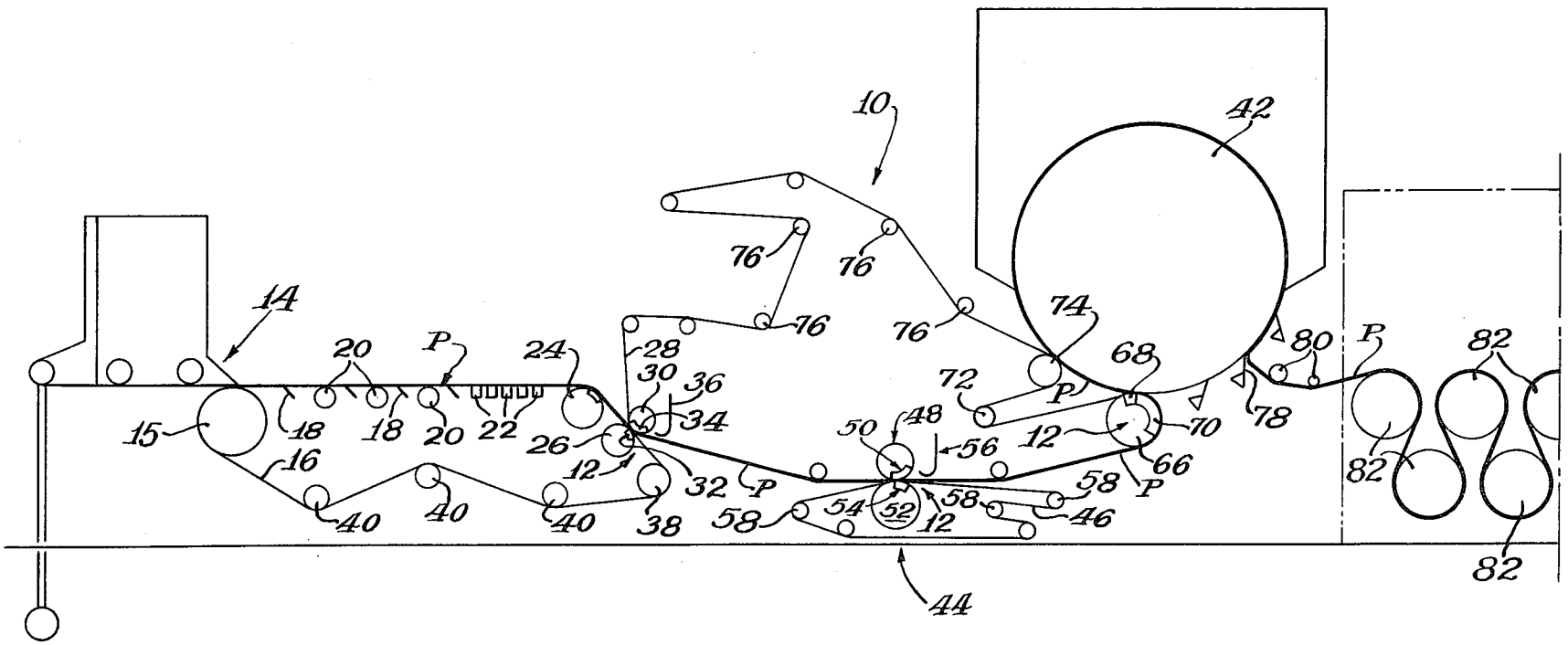
FIG. 1 is a side elevational schematic view of a paper making machine of the type which includes a forming wire, a top pick up felt, a bottom felt, a press section, pressure rolls, and a Yankee dryer, wherein my improved devices are used for substantially assuring that the paper continues to move along the desired preselected path of travel.

Referring to FIG. 1, there is a schematic showing of apparatus, generally 10, for processing paper wherein my improved device, generally 12, assists in maintaining substantially continuous movement of the paper sheet P through the machine 10, along a preselected and desired path of travel, without any deviation therefrom. The paper making machine 10 includes a head box and slice section 14, where a dilute slurry of pulp fibers, at a concentration of about 0.2 – 0.6% is conventionally squirted or placed onto a paper forming wire of mesh 16.

Drainage of water from the wet slurry takes place almost immediately by action of gravity. The drainage is assisted by foils 18, rolls 20, and suction boxes 22, the foils 18 and rolls 20 being alternatly positioned along the underside of the forming wire 16. The wire 16 and paper P on the upperside of the wire 16 move from the breast roll 15 to the suction hip roll 24. The suction hip roll 24 also assists in removing water from the paper P.

Figure 2:
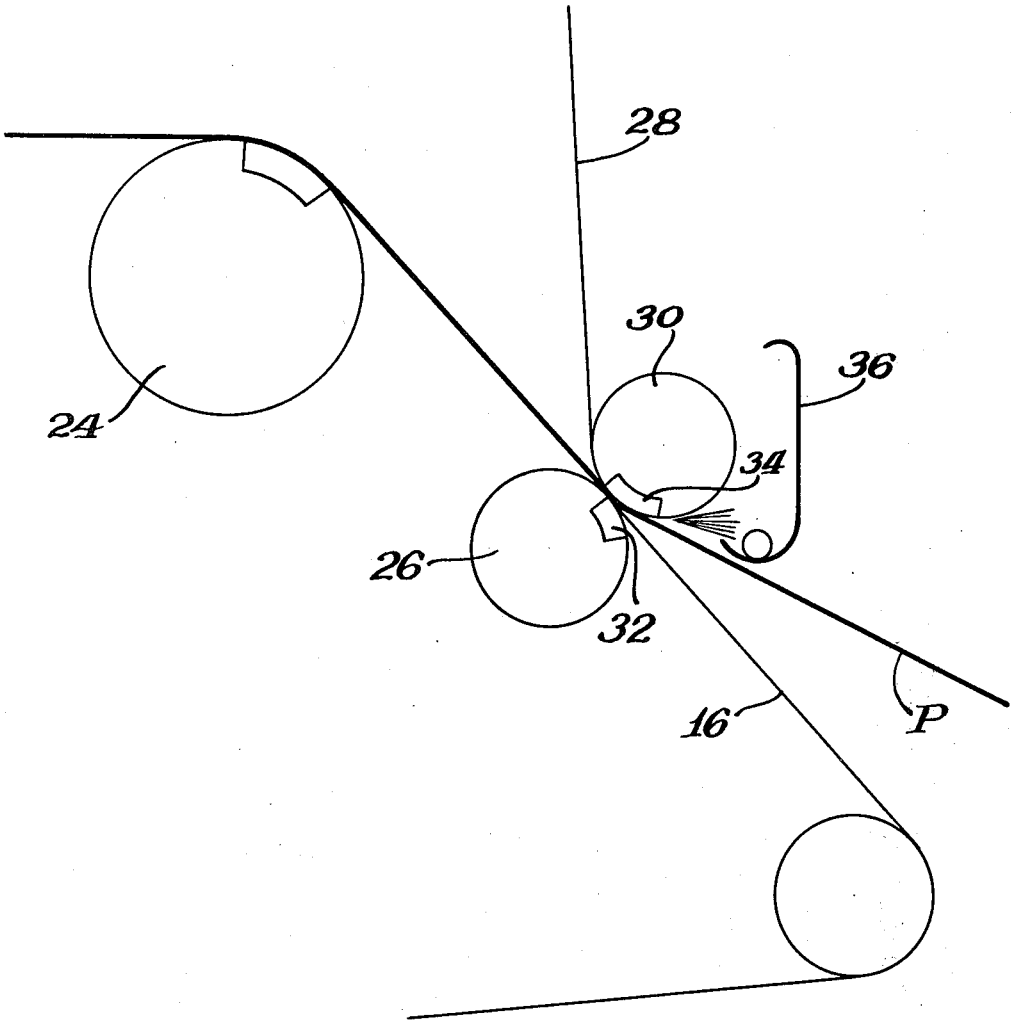
FIG. 2 is an enlarged, side elevational, schematic view of the portion of the paper making apparatus of FIG. 1 wherein my invention is used at the position where the paper is transferred from the forming wire to the pick-up felt.

The paper P is carried on the upperside of the forming wire 16 to the nip defined between the forming wire 16 and an air pressure blow roll 26, on one hand, and the top or pick-up felt 28 and the suction pick-up roll 30, on the other hand. In conventional Fourdrinier paper making machines, no air pressure or blow roll 26 is used, the blow roll 26 being one embodiment of my invention. In Dearden U.S. Pat. No. 2,780,967, mentioned above, air pressure from a foreshortened "blow roll" blows the "tail" of the paper roll from the interstices of the forming wire from a position "in advance of the nip". After the transer, the air pressure is cut off. The transfer of the paper P from the forming wire 16 to the top pick-up felt 28 occurs at this position, which is the first nip encountered in the paper making machine. It is essential for production efficiency that a proper transfer be made by the paper P to the top or pick-up felt 28, the blow roll 26 assisting in this transfer. Referring also to FIG. 2, the blow roll 26 is desirably constructed in a manner similar to suction rolls which are commonly used in various types of paper making machines, including the Fourdrinier type. Suction rolls generally comprise a rotating cylindrical roller having perforations therein which communicate with a fixed vacuum chamber within the roll. In the blow roll 26, the construction is substantially the same as a suction roll except that a pressure chamber 32 is located therein.

As best shown in FIG. 2, the pressure chamber 32 is located at the contact point or nip between the rollers 26 and 30 and specially extends from a position adjacent an imaginary line joining the centers of the rolls 26 and 30 to a position about 30°–45° beyond such line on the outgoing side of the nip. The suction roll 30 is also constructed with a perforated rotary outer surface and a vacuum chamber 34 is provided within the roller 30. Since at the contact point or nip between the rolls 26 and 30 water is being squeezed out of the paper P, the top or pick-up felt 28 absorbs the water and the vacuum within the vacuum chamber 34 of the suction roll 30 draws the water into the holes of the shell. The vacuum is released on the outgoing side of the suction roll 30 and the water is thrown out, as schematically shown in FIG. 2, and into a collecting pan 36.

The gas pressure in the pressure chamber 32 is peferably air at a pressure of about 0.5 to 50 psi. Such air pressure urges or blows the paper P away from the relatively porous mesh of the forming wire 16 and towards the top felt 28 to assist in the proper transfer of the paper P to the pick-up felt 28. In this way, any tendency that the paper P might have to remain with the wire 16 rather than transfer to the felt, as by being pressed slightly into the mesh of the wire 16, is substantially avoided.

Figure 6:
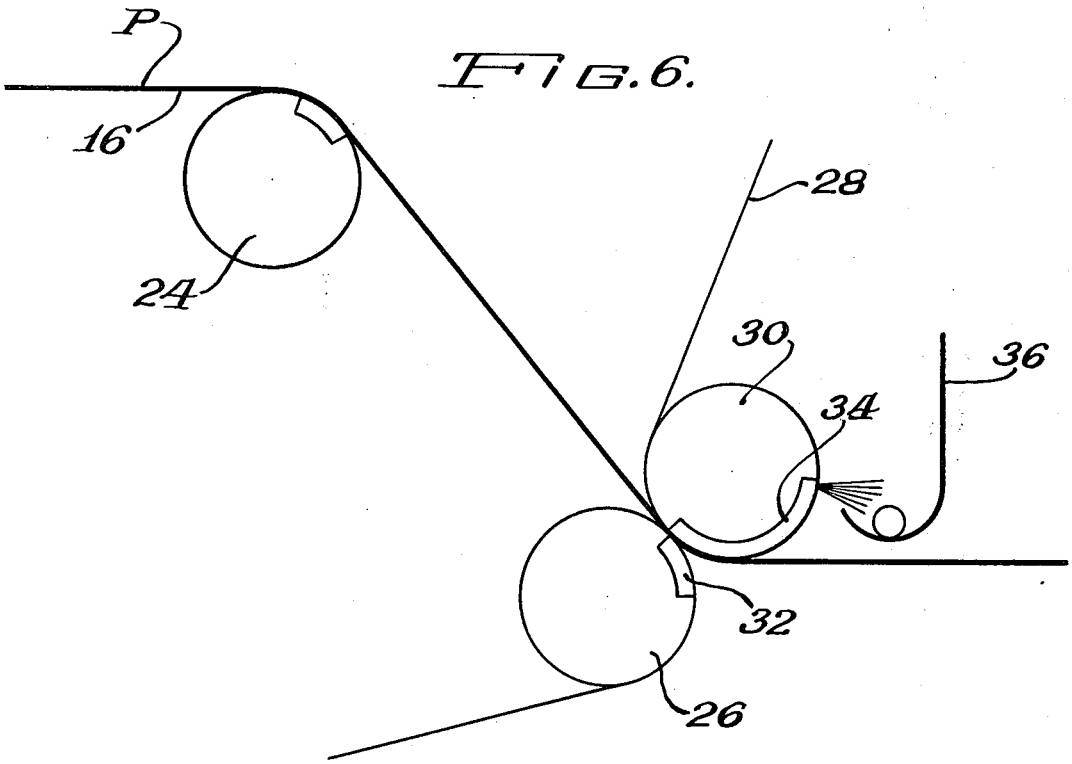
FIG. 6 is an enlarged, side elevational, schematic view of an alternate embodiment wherein my invention is used where the paper transfers from the forming wire to the pick-up felt and the wire turning roll is also the blow roll.

Referring to FIG. 6, an alternate embodiment is shown wherein the wire turning roll 26 also acts as the blow roll for guiding and turning the forming wire 16 as it returns to receive more paper pulp at the slice 14. The only significant difference in the embodiments of FIG. 2 and FIG. 6 is that the blow roll 26 additonally functions as a wire turning roll. Advantageously, the blow roll 26, in the embodiment of FIG. 6, may be driven in order to move the forming wire 16.

Referring again to the emmbodiment of FIG. 1, the forming wire 16 passes around the wire turning roll 38 for return to the starting position for receiving pulp at the slice 14. In the return path of travel of the wire 16 to the breast roll 15, the forming wire 16 is guided around a series of return rolls 40. At the nip between the blow roll 26 and the pick-up roll 30, there is a pressure of about 5 – 300 pounds per lineal inch.

After being received on the pick-up felt 28, the paper P is carried toward the Yankee dryer 42. Although not always used, the machine 10 includes a press section, generally 44, to remove additional water from the paper P before the paper reaches the Yankee dryer 42 for completion of the desired drying of the paper. Normally, at the press section 44, the roll which bears against the top felt is merely in plain press roll, while the roll that bears against the bottom felt is a suction roll. In the embodiment of FIG. 1, a top press roll 48 is provided with a vacuum chamber 50 therein and a press blow roll 52 with air pressure chamber 54 therein bears against the bottom felt 46. The press section 44 defines the second position in the paper making machine 10 at which the paper P passes between a pair of rolls which define a nip or contact location therebetween.

As with the top felt 28, the bottom felt 46 also absorbs the water from the paper passed between the rolls in the press section 44. Suitable means (not shown) may be provided adjacent the bottom felt 46 to remove the water therefrom. In the embodiment of FIG. 1, the press blow roll 52 functions in a manner similar to the blow roll 26. Although the bottom felt 46 is normally constructed to be more coarse than the top pick-up felt 28, a situation sometimes occurs when the top felt 28 is replaced and the new top felt is rougher than the used bottom felt. Under such circumstances, the paper P may have a tendency to remain with the smoother, worn bottom felt 46. The air pressure in the pressure chamber 54, however, passes through the air permeable bottom felt 46 so as to urge or to effectively "blow" the paper P in a direction so that it remains adjacent the top pick-up felt 28 for transportation of the Yankee dryer 42. A water collecting pan 56 is located adjacent the vacuum roll 48 and catches water after the vacuum is released beyond the suction box. As in the case of the blow roll 26, the press blow roll 52 has its pressure chamber 54 commencing at a position adjacent the imaginary line which passes between the centers of the rolls 48 and 52, and extends for approximately 30° beyond the line on the outgoing side of the nip. The bottom felt 46 is guided around a plurality of felt rolls 58 for movement thereof back to the inlet side of the nip between the rolls 48 and 52.

Figure 3:
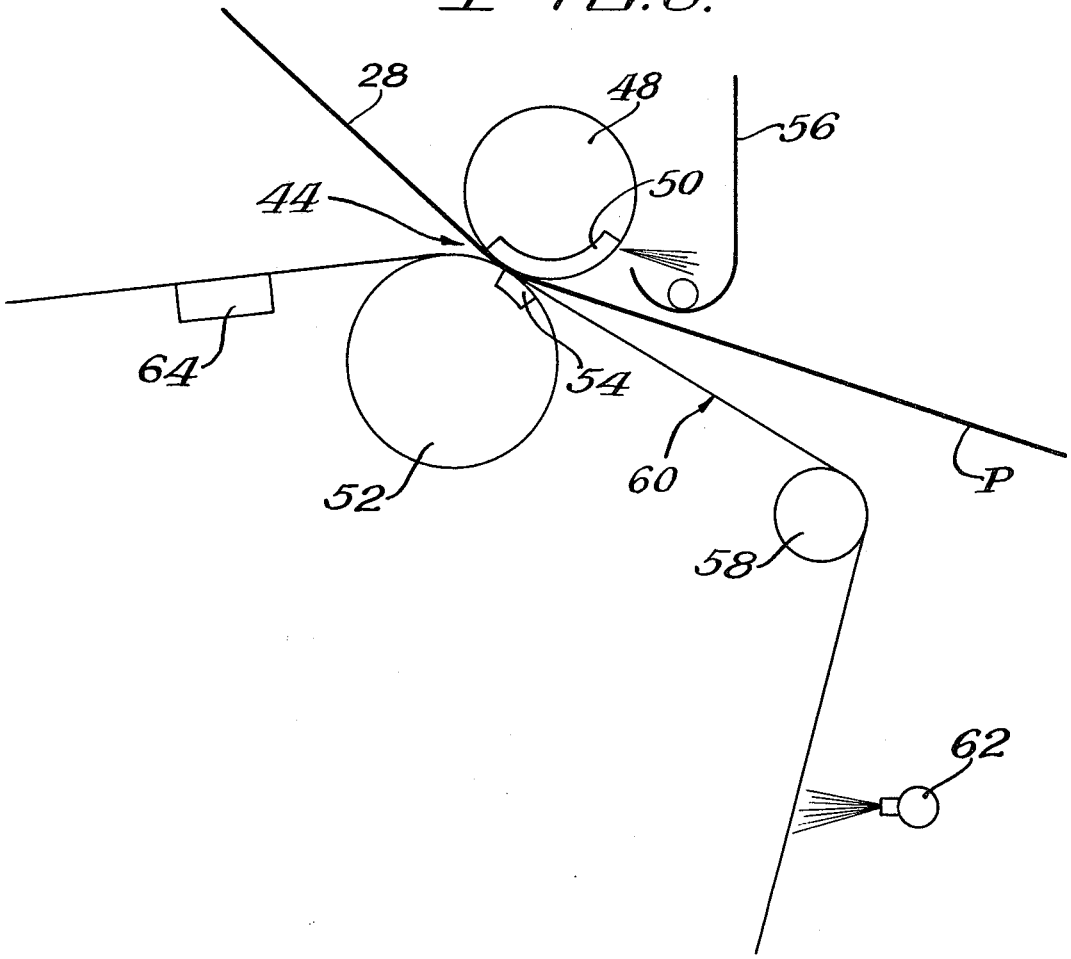
FIG. 3 is an enlarged, side elevational, schematic view of the portion of a paper forming machine, wherein my invention is used in the press section, and a plastic fabric is used.

Referring to FIG. 3, an alternate embodiment useful in the press section 44 is shown. In this embodiment, the bottom felt 46 is replaced by a belt of plastic or wire mesh 60 guided around the blow roll 52. In this embodiment, the press blow roll 52 is used and there is even greater assurance that the paper P will remain with the top pick-up felt 28 because the plastic or wire mesh material 60 is more coarse than the pick-up felt 28. Desirably, in order to wash the mesh 60, a water shower may be applied from a nozzle arrangement 62, as shown in FIG. 3. Also, in order to assure that the mesh is dried before it reaches the nip between the rolls 48 and 52, a suction box 64 may bear against the inner surface of the mesh 60 for withdrawing water. Alternatively, an air shower (not shown) can be used to blow water off.

Figure 4:
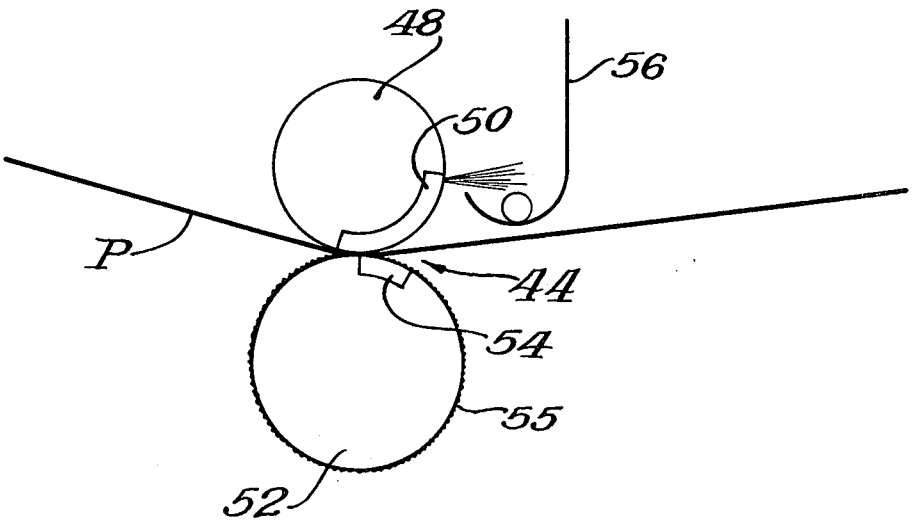
FIG. 4 is an enlarged, side elevational, schematic view of an alternative embodiment wherein my invention is used in a press section which does not use a bottom felt or a plastic fabric belt.

Still another embodiment of the invention is shown in FIG. 4 wherein no bottom felt or plastic fabric belt is used. In this embodiment, the blow roll 52 cannot have a smoother surface than the top felt 28 because otherwise the paper P would tend to wrap around the smoother blow roll 52 regardless of the presenece of air pressure in the pressure chamber 54. For this reason, the bottom roll is purposely given a rough surface. This can be done by giving the surface a rough texture or by using a shrink sleeve. The shrink sleeve 55 comprises a woven belt of plastic wire similar to the screen used for forming paper. The belt is woven with a circumference slightly larger than the circumference of the press roll and then shrunk on tightly with heat. Water pressed out at the nip enters the holes of the top suction press 48 and is held there until the vacuum is released and the water is thrown into the collecting pan 56. Any tendency of the paper to stick into the mesh of the shrink sleeve is overcome by the air pressure from the blow roll 52 which urges the sheet to follow the felt. The air blowing through the mesh of the shrink sleeve also tends to keep it clean. Desirably, the pressure at the nip between the presses 48 and 52 is about 50–400 pounds per lineal inch. The embodiments of FIGS. 3 and 4 represent particularly valuable uses of the invention.

Referring again to FIG. 1, following passage of the paper P and top pick-up felt 28 through the press section 44, the paper P continues on to the nip defined between the pressure roll 66 and the smooth hot Yankee dryer 42. The pressure roll 66 preferably includes a rotating perforated outer surface having a fixed vacuum chamber 70 and a fixed pressure chamber 68 within the pressure roll 66. The vacuum chamber 70 extends for about 90° ahead of the nip or contact position between the Yankee dryer 42 and the pressure roll 66 on the ingoing or inlet side of the nip. The pressure chamber 68 is also located at the nip, adjacent the vacuum chamber 70, and extends for approximately 20° on the outgoing side of the nip. Again, the purpose of the vacuum chamber 70 is to suck water from the top pick-up felt 28, which water has been pressed into the top felt 28 from the paper P. The suction box 70 is made large so that for a considerable distance before the nip, the felt and the wet paper are subject to suction. This is especially important in a single felt machine where the paper and the felt are very wet. The pressure roll 66 with the pressure chamber 68 therein blows or urges the paper P towards the hot smooth surface of the Yankee dryer 42. The pressure in the blow roll 66 also tends to offset, reduce, or eliminate the tendency of the paper P to blister or separate from the hot cylindrical surface of the Yankee dryer 42. Normally, negative pressure at the nip reduces the boiling point of the water and increases the tendency of the sheet to blister from the hot surface thereof. In this invention, the introduction of the pressurized air from the pressure chamber 68 within the pressure roller 66 acts to reduce or eliminate the negative pressure. The used of the blow roll 66 in combination with the Yankee dryer is considered to be a particularly important aspect of the applicant's invention.

The paper P is dried on the surface of the Yankee dryer 42 following transfer thereof from the top pick-up felt 28. The top pick-up felt 28 passes around a felt roll 72 and is then passed around a second pressure roll 74 which provides a nip with the surface of the Yankee dryer 42. After passing around the pressure roll 74, the top pick-up felt 28 passes around a plurality of felt rolls 76 and is returned to the nip between the wire mesh 16 and the suction roll 30 in order to again pick up paper P from the wire mesh 16.

The paper is removed from the Yankee dryer 42 and creped by the doctor blade 78. At this location, the paper P is self-sustaining and is guided around the rolls 80. The drying of the paper P is either completed on the Yankee or partially on the Yankee and finished on the after dryers 82. Subsequently, the paper P is wound of a reel.

Figure 5:
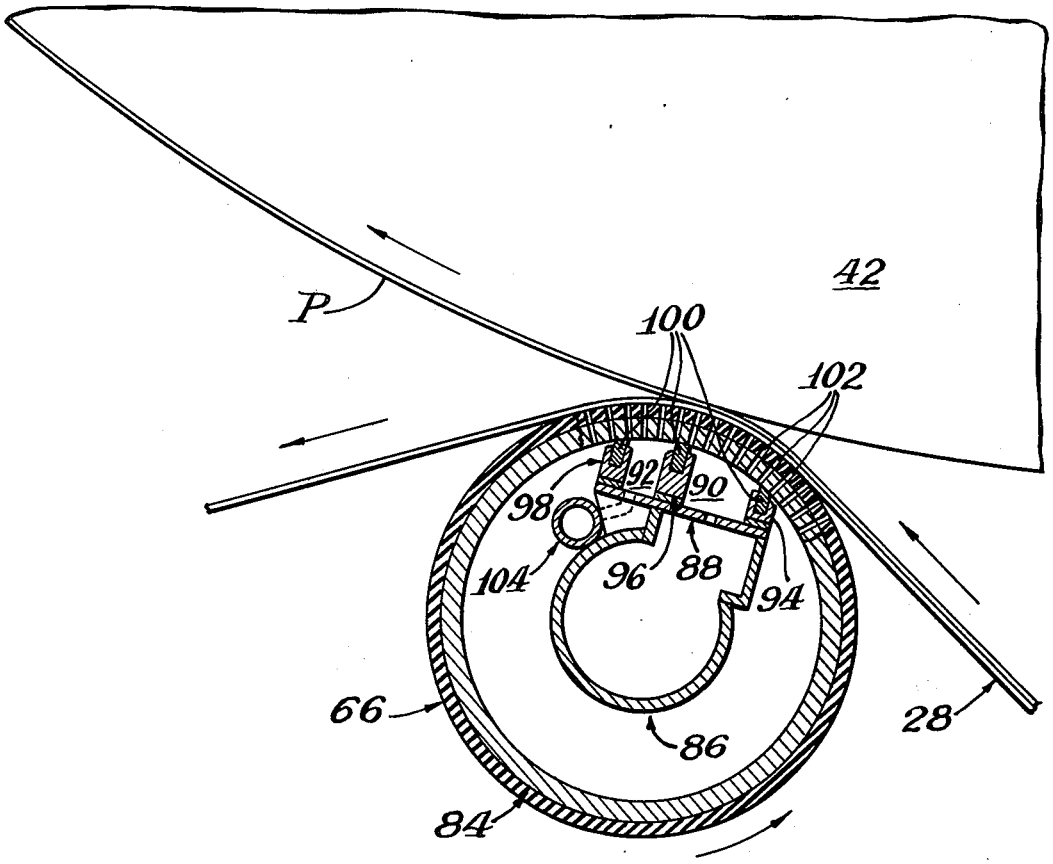
FIG. 5 is an enlarged, side elevational, schematic view showing one form of my invention used at the nip between a pressure roll and the Yankee, the details of construction of the pressure roll being shown in somewhat greater detail than the embodiment of FIGS. 1–4.

Referring to FIG. 5, a preferred construction of one type of blow roll used in my invention is shown in some detail. This is a blow roll with two boxes, one being a pressure chamber and one being a vacuum chamber, adjacent to each other. The other type of blow roll has a pressure box or chamber only and co-acts with an ordinary suction roll. Such blow rolls are rolls 26 and 52, shown in FIGS. 1 – 4 and 6. The paper P and top pick-up felt 28 are carried to the nip formed between the Yankee dryer 42 and the external cylindrical surface of the smaller diameter pressure roll 66. The pressure roll 66 has a cylindrical outer shape and a hollow interior. The pressure roll 66 is rotatably driven by suitable means (not shown) in a counterclockwise direction as viewed in the drawings, nd the Yankee dryer 42 is also rotated by suitable means (not shown) in a clockwise direction. The peripheral speed and direction of the Yankee dryer 42, of the pressure roll 66, and of the pick-up felt 28 are all the same. The pressure roll 66 bears against the periphery of the driven Yankee dryer so that the paper is pressed therebetween and is transferred to the smooth surface of the Yankee dryer, as previously described. The surface of the pressure roll 66 is covered by a rubber layer 84. A plurality of openings are drilled through the rubber layer 84 and through the cylindrical metal portion of the pressure roll 66 so that there is communication between the suction box 90 and the outer surface of the roll 66 and also between the pressure box 92 and the surface of the roll 66.

A fixed support frame 86, generally circular in shape, is rigidly secured within the roll 66 suitable means (not shown). A support plate 88 is fixedly carried on the frame 86 and the support plate 88, in turn, carries a vacuum chamber-defining structure 90 and a pressure chamber-defining structure 92. The vacuum chamber 90 is defined between a generally upright outer wall 94 and an intermediate wall 96. The pressure chamber 92 is generally defined between the intermediate wall 96 and an opposite outer wall 98. The upper edges of the walls 94, 96 and 98 each carry seals 100 which bear against the moving inner surface of the cylindrical pressure roll 66. The intermediate wall 96 has a seal 100 which is located generally along the imaginary line extending from the center of rotation of the pressure roll 66 to the nip or line contact position between the roll 66 and the Yankee dryer 42. It is to be understood that the entire assembly of the vacuum and pressure chambers 90 and 92 are constructed to be moved clockwise or counterclockwise so as to position the intermediate wall 96 slightly forward of or back of the nip in order to adjust the device to optimum operating conditions.

A vacuum source (not shown) is interconnected to the vacuum chamber 90 so that a suitable vacuum is constantly provided therein, a vacuum being applied to the openings 102 in the roll 66 and the area between two of the seals 100 and the outer wall 94 and the intermediate wall 96. Preferably, a vacuum of about 5 inches of mercury to about 25 inches of mercury is used in the vacuum chamber 90, as in other vacuum chambers in the apparatus.

Immediately after the top felt 28 passes the nip at the Yankee dryer 42, the pressure is applied from the pressure chamber 92 on the outgoing side of the nip through the apertures 102, and through the air permeable top pick-up felt 28. The air pressure acts against the under surface of the paper P to offset the blistering tendency of the paper P as it contacts the hot surface of the Yankee dryer 42. The pressure chamber 92 communicates with an air header 104, which, in turn, communicates with a suitable source of air pressure for applying pressure, preferably between about 0.5 psi and 30.0 psi to the undersurface of the felt 28 and then to the under surface of the paper P.

The forming wire, the top pick-up felt, and the bottom felt are made of conventional materials used in paper making equipment. Although the air permeability of these materials may vary, the effectiveness of my process and apparatus may be readily adjusted to optimum operating conditions as, for example, by adjusting the air pressure in the pressure chambers at the blow rolls.

Although in the foregoing, specific examples of my invention have been provided, it is to be understood that my invention is applicable to any situation where a pair of contacting members, that is, rolls, felt, Yankee dryer, etc., receive paper at a nip defined therebetween and the paper is to follow a preselected path of travel following the nip. The invention is not limited to the particular mode used for transporting the paper to or from the nip. Although it should be apparent from the foregoing, the air pressure in the various blow rolls described above blows during substantially the entire time that paper is being processed, that is, the air blows continuously; brief interrruptions in blow air, not affecting the transfer operations is intended to come within the meaning of the term "continuously". Also, as should be apparent from the foregoing, the blow rolls are coextensive or substantially coextensive with the width of the paper being processed and generally are coextensive with the mating processing member which defines the nip.

While in the foregoing, I have provided a detailed description of particular embodiments of the present invention, it is to be understood that all equivalents obvious to those having skill in the art are to be included within the scope of the invention as claimed.

I claim:

1. A paper making apparatus for assuring movement of paper in the desired path of travel after passing through a nip in a closed draw transfer system, said apparatus comprising, in combination, a gas permeable top pick-up felt having paper carried thereon for processing, a Yankee dryer for assisting in defining said nip with said felt, said paper being located between said felt and said Yankee dryer at said nip, said nip having an outgoing side and an incoming side, means for moving said felt and thereby said paper to said nip for processing said paper at said nip, a roller associated with said felt for cooperating in defining said nip, a chamber defined with said roller, means for communicating the outer surface of said roller with the interior of said chamber, means for substantially continuously applying gaseous pressure from within said chamber through said communicating means in a direction towards said Yankee dryer on said outgoing side of said nip through said gas permeable felt and against said paper being passed through said nip so as to urge said paper onto said Yankee dryer, only said felt carrying said paper to said nip and only said Yankee dryer carrying said paper from said nip after passing through said nip.

2. The apparatus of claim 1 wherein said roller also contains a vacuum chamber on the incoming side of said nip for cooperating in receiving water from said pick-up felt and from said paper.

3. The apparatus of claim 1 wherein said gaseous pressure applying means is substantially coextensive with the width of said paper.

4. The process of claim 1 wherein said roller includes perforations for defining said communicating means and also includes a gaseous air pressure chamber defined on said outgoing side of said nip for defining said gaseous pressure applying means.

* * * * *